US005638699A

United States Patent [19]

Yamamoto et al.

[11] Patent Number: 5,638,699

[45] Date of Patent: Jun. 17, 1997

[54] HIGH PURITY NITROGEN GAS GENERATOR

[75] Inventors: Takao Yamamoto, Kobe; Shingo Koizumi, Akashi, both of Japan

[73] Assignee: Teisan Kabushiki Kaisha, Tokyo, Japan

[21] Appl. No.: 685,624

[22] Filed: Jul. 24, 1996

[30] Foreign Application Priority Data

Jul. 26, 1995 [JP] Japan ..... 7-190512

[51] Int. Cl.[6] ..... F25J 3/04

[52] U.S. Cl. ..... 62/643; 62/913

[58] Field of Search ..... 62/643, 656, 912, 62/913, 616, 653, 657

[56] References Cited

U.S. PATENT DOCUMENTS

| | | | |
|---|---|---|---|
| 4,671,813 | 6/1987 | Yoshino | 62/913 X |
| 4,698,079 | 10/1987 | Yoshino | 62/913 X |
| 5,058,387 | 10/1991 | Kamrath | 62/913 X |
| 5,084,081 | 1/1992 | Rohde | 62/913 X |
| 5,157,927 | 10/1992 | Darchis et al. | 62/913 X |
| 5,333,463 | 8/1994 | Garnier et al. | 62/913 X |
| 5,355,680 | 10/1994 | Darredeau et al. | 62/913 X |
| 5,373,699 | 12/1994 | Gastinne et al. | 62/913 X |

*Primary Examiner*—Christopher Kilner

*Attorney, Agent, or Firm*—Young & Thompson

[57] ABSTRACT

A high purity nitrogen gas generator is provided which can be rapidly returned to a stable state when boil-off gas is generated in a liquid nitrogen storage tank 10. The high purity nitrogen gas generator includes a liquid nitrogen storage tank 10, a rectification column 7, a liquid nitrogen introduction pipe P15 for supplying liquid nitrogen from the liquid nitrogen storage tank to the rectification column, an inverted U-type pipe P13 whose upper end is positioned at a height in the vicinity of the top portion of said liquid nitrogen storage tank connected to the bottom portion of said liquid nitrogen storage tank 10, said liquid nitrogen storage tank 10 and said liquid nitrogen introduction pipe P15 being connected with each other by way of said inverted U-type pipe, the upper end of the inverted U-type pipe and the top portion of said liquid nitrogen storage tank are connected with each other by means of a pipe P17 and a control valve V3 provided on the way of said pipe P17.

1 Claim, 2 Drawing Sheets

HIGH PURITY NITROGEN GAS GENERATOR

The present invention relates to a unit for generating high purity nitrogen gas from feed air by use of a rectification column, which may contain packings.

Figure 2:
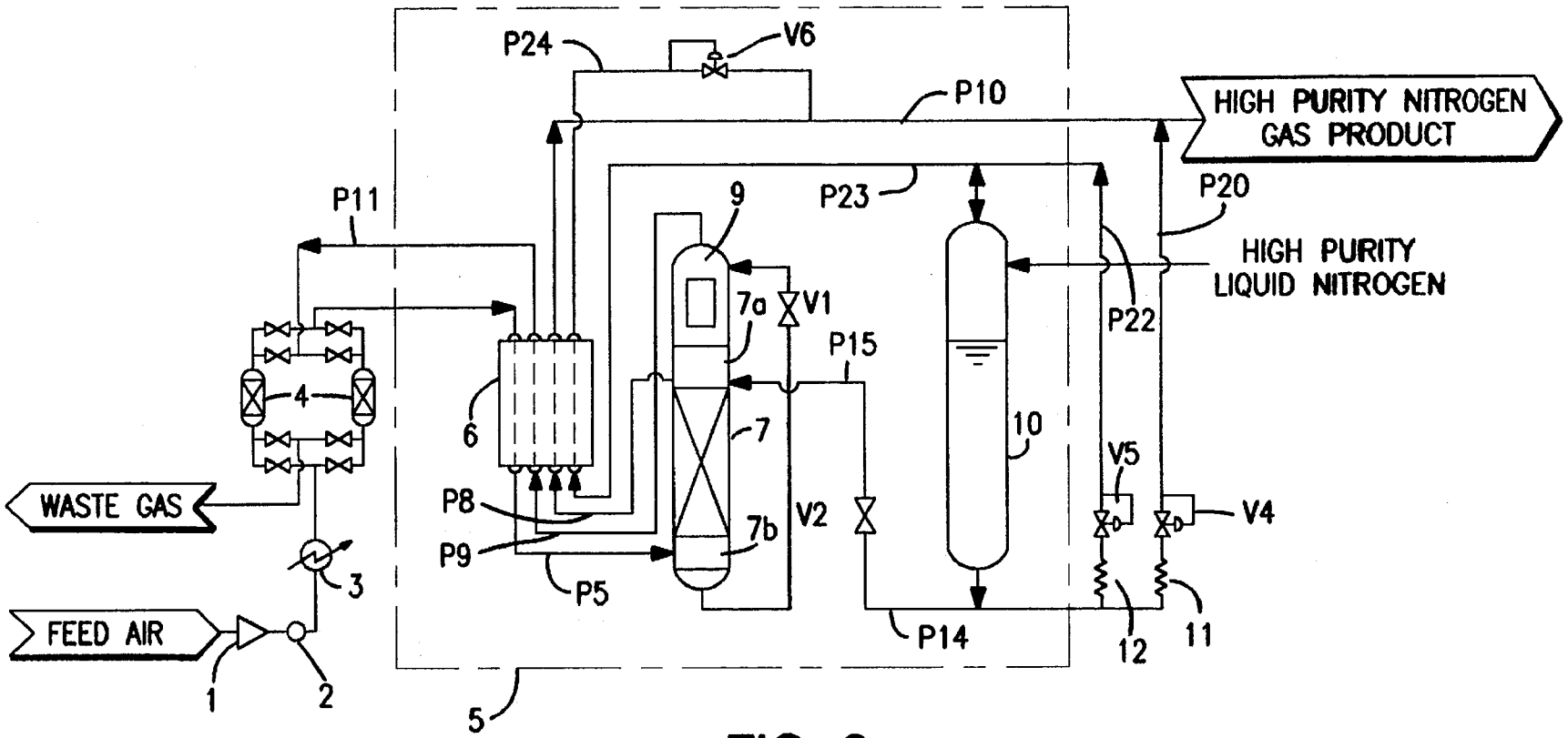

In FIG. 2, one example of a prior art purity nitrogen gas generator is shown. The main part of this unit is composed of a packing type rectification column 7 for separating and purifying nitrogen gas of high purity from compressed air as a feed material, a liquid nitrogen storage tank 10 for supplying liquid nitrogen of high purity as a reflux liquid to the packing type rectification column 7 and a heat exchanger 6 for cooling down the compressed air to be supplied to the packing type rectification column 7, and this main part is accommodated in a vacuum type insulated container 5.

As portions attached to the above mentioned main part, there are provided a compressed air supply system equipped with a compressor 1 and a decarbonating and drying column 4, a liquid nitrogen introduction pipe P15 for supplying liquid nitrogen of high purity from the liquid nitrogen storage tank 10 to the vicinity of the top portion of the packing type rectification column 7, an expansion valve V1 for adiabatically expanding oxygen-rich liquid collected in the bottom portion **7*b* of the packing type rectification column 7 to obtain very low temperature air, a very low temperature air pipe P9 for sending the very low temperature air to the heat exchanger 6 as a part of refrigerant, a low temperature nitrogen gas pipe P8 for extracting nitrogen gas of high purity from the top portion 7*a* of the packing type rectification column 7 and supplying the extracted nitrogen gas to the heat exchanger 6 as another part of the refrigerant, a nitrogen gas delivery pipe P10 for supplying nitrogen gas passed through the heat exchanger 6 to external consumption facilities, a bypass pipe P14 for connecting the bottom portion of the liquid nitrogen storage tank 10 with the nitrogen gas delivery pipe P10, and an evaporator 11 provided on the bypass pipe P14 so as to evaporate liquid nitrogen introduced from the liquid nitrogen storage tank 10**.

Moreover, there are provided a pressurization pipe P22 connecting the top portion of the liquid nitrogen storage tank 10 with the bypass pipe P14, which has a valve V5 and an evaporator 12, as a pressurizing means in a case where the pressure of the liquid nitrogen storage tank 10 is lowered by the consumption of liquid nitrogen, and further gas release pipes P23, P24 connecting the top portion of the liquid nitrogen storage tank 10 with the high purity nitrogen gas delivery pipe P10, which have a control valve 6 provided through the intermediary of the heat exchanger 6 disposed on the way, as a gas releasing means in a case where the pressure of the liquid nitrogen storage tank 10 becomes excessive.

In the aforementioned unit, the production of high purity nitrogen gas will be carried out as follows.

Liquid nitrogen of high purity introduced from the liquid nitrogen storage tank 10 is supplied to the vicinity of the top portion of the packing type rectification column 7, while compressed air as a feed material, which has passed through the heat exchanger 6 so as to be cooled down, is supplied to the vicinity of the bottom portion of the packing type rectification column 7. In the inside of the packing type rectification column 7, the compressed air and liquid nitrogen are brought into countercurrent contact with each other so that oxygen (with a boiling point of −183° C. at 1 ata) in the compressed air is selectively liquefied and the liquid nitrogen (with a boiling point of −196° C. at 1 ata) is evaporated. In the bottom portion **7*b* of the packing type rectification column, as a result, oxygen-rich liquid air is collected, and in the top portion 7*a*** of the packing type rectification column, nitrogen gas generated by the evaporation of the liquid nitrogen and nitrogen gas separated from the compressed air are collected as nitrogen gas of high purity.

The oxygen-rich liquid air collected in the bottom portion **7*b* of the packing type rectification column is sent to the expansion valve V1**, where it is adiabatically expanded to very low temperature air.

After the very low temperature air is sent to the heat exchanger 6 through the very low temperature air pipe P9 so as to be used as a part of a refrigerant for cooling down the compressed air of the feed material, it will be released to the atmosphere through a pipe P11.

After the separated and purified nitrogen gas is extracted from the top portion **7*a* of the packing type rectification column and supplied as a part of the refrigerant to the heat exchanger 6 through a low temperature nitrogen gas pipe P8**, on the other hand, it will be supplied as product nitrogen gas of high purity to external consumption facilities through the nitrogen gas delivery pipe.

When boil-off gas is generated in the liquid nitrogen storage tank 10 due to an abnormality of heat balance in the unit, the control valve 6 will be opened to release the boil-off gas to the nitrogen gas delivery pipe P10 through the gas release pipes P23, P24, whereby the internal pressure of the liquid nitrogen storage tank 10 is stabilized.

In such a high purity nitrogen gas generator of the prior art as mentioned above, however, there has been some limit to the amount of nitrogen gas which flows to the nitrogen gas delivery pipe P10 through the gas release pipes P23, P24, heat exchanger 6, control valve V6 and the likes when the boil-off gas is once generated. Accordingly, the pressure of the liquid nitrogen storage tank 10 has not been lowered rapidly and the liquid nitrogen of high purity has been uselessly wasted. Further, it has been desired to simplify an installation related to the treatment of boil-off gas, which comprises system parts for boil-off gas such as the gas release pipes P23, P24 and heat exchanger 6.

According to the present invention in order to solve such problems, an inverted U-type pipe whose upper end is positioned at a height in the vicinity of the top portion of said liquid nitrogen storage tank is connected to the bottom portion of said liquid nitrogen storage tank, said liquid nitrogen storage tank and said liquid nitrogen introduction pipe are connected with each other by way of said inverted U-type pipe, the upper end of the inverted U-type pipe and the top portion of said liquid nitrogen storage tank are connected with each other by a connection pipe and a control valve is provided on the way of said connection pipe, wherein nitrogen gas is introduced from the top portion of said liquid nitrogen storage tank into the upper end of this inverted U-type pipe by opening the control valve when the pressure of said liquid nitrogen storage tank exceeds a predetermined value.

Thus, it is possible to interrupt the current of liquid nitrogen from the liquid nitrogen storage tank to the packing type rectification column rapidly because the current of liquid nitrogen in this pipe is siphon-broken.

The present invention resides in a high purity nitrogen gas generator comprising:

a packing type rectification column in which cooled compressed air is introduced from the vicinity of its bottom portion, this compressed air and liquid nitrogen introduced from the vicinity of its top portion are brought into countercurrent contact with each other to liquefy oxygen in the compressed air, and the resulting air is reservoired in the bottom portion as oxygen-rich liquid air and separated nitrogen gas is collected in the top portion;

a liquid nitrogen storage tank for storing liquid nitrogen;

a liquid nitrogen introduction pipe for supplying liquid nitrogen from the bottom portion said liquid nitrogen storage tank to the vicinity of the top portion of said packing type rectification column;

a heat exchanger for cooling down the compressed air to be supplied into the packing type rectification column;

an expansion valve for adiabatically expanding said oxygen-rich liquid air extracted from the bottom portion of the packing type rectification column to obtain very low temperature air;

a very low temperature air pipe for supplying this very low temperature air to said heat exchanger as a refrigerant; and a nitrogen gas delivery pipe for supplying said nitrogen gas extracted from the top portion of the packing type rectification column to external consumption facilities, characterized in that an inverted U-type pipe whose upper end is positioned at a height in the vicinity of the top portion of said liquid nitrogen storage tank is connected to the bottom portion of said liquid nitrogen storage tank, said liquid nitrogen storage tank and said liquid nitrogen introduction pipe are connected with each other by way of said inverted U-type pipe, the upper end of the inverted U-type pipe and the top portion of said liquid nitrogen storage tank are connected with each other by means of a pipe and a control valve is provided on the way of said pipe, where when the pressure of said liquid nitrogen storage tank exceeds a predetermined value, the control valve is opened so as to introduce nitrogen gas from the top portion of said liquid nitrogen storage tank to the upper end of this inverted U-type pipe.

Figure 1:
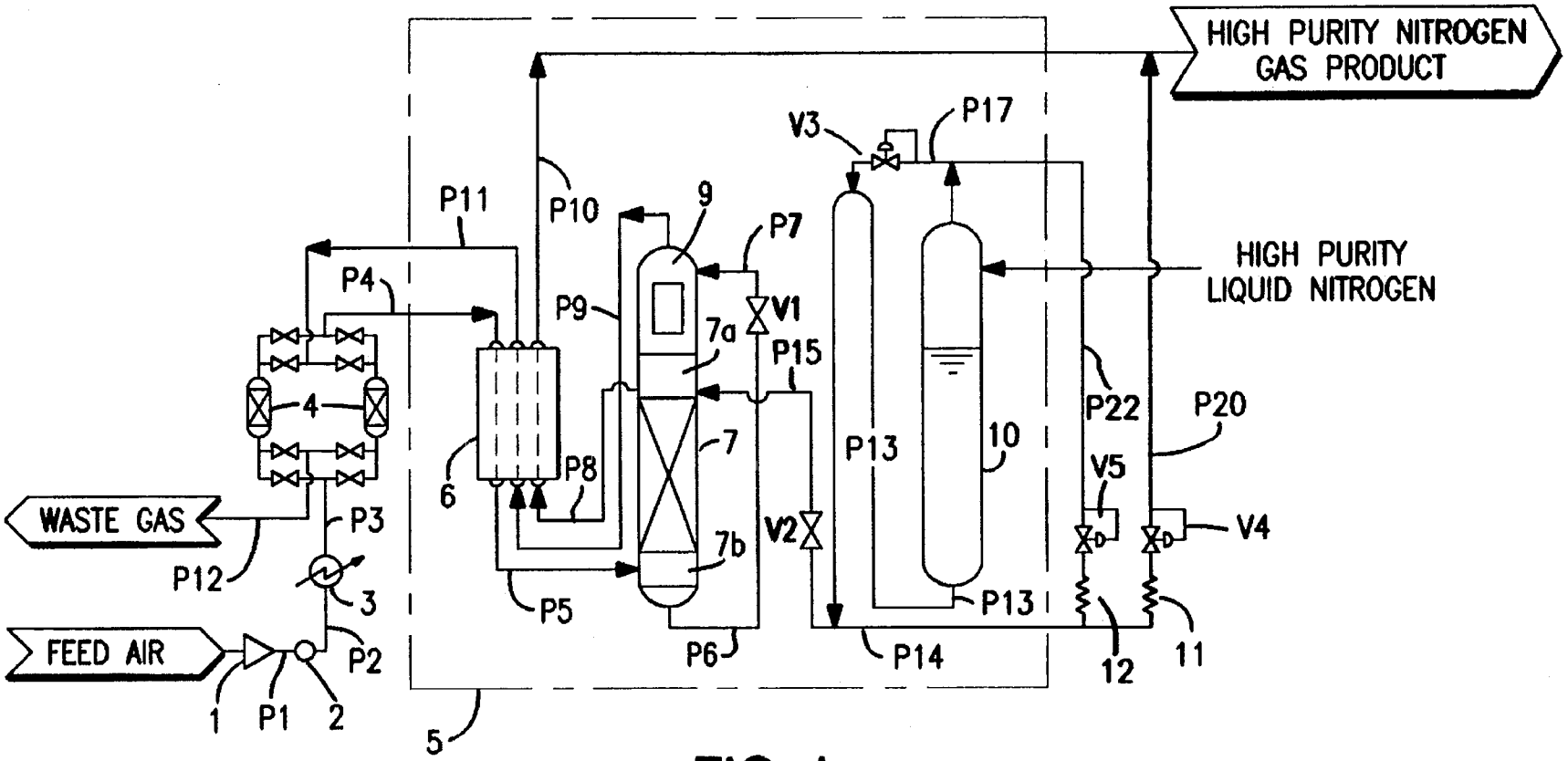

In FIG. 1, a flow diagram is shown which relates to one example of the high purity nitrogen gas generator according to the present invention. In the drawing, the reference numeral 7 represents a packing type rectification column (this is a structured packing type rectification column in this embodiment), 10 represents a liquid nitrogen storage tank, P15 represents a liquid nitrogen introduction pipe, 6 represents a heat exchanger, V1 represents an expansion valve, P9 represents a very low temperature air pipe, P10 represents a liquid nitrogen delivery pipe, P14 represents a bypass pipe, P13 represents an inverted U-type pipe, P17 represents a connection pipe for connecting the upper end of the inverted U-type pipe with the top portion of said liquid nitrogen storage tank, and V3 represents a control valve.

To the rear stage of an air compressor 1 for supplying compressed air as a feed material, a decarbonating and drying column 4 is connected by way of a catalyst column 2 and a cooler 3, and to the rear stage of the decarbonating and drying column 4, the heat exchanger 6 for cooling down the compressed air is connected by way of a pipe P4. A pipe P5 for the compressed air coming out of the heat exchanger 6 is connected to the vicinity of the bottom portion of the regular packing type rectification column 7. To the vicinity of the top portion of the regular packing type rectification column 7 is connected the nitrogen introduction pipe P15. This nitrogen introduction pipe P15 and the bottom portion of the liquid nitrogen storage tank 10 are connected with each other by way of the inverted U-type pipe P13.

A condenser 9 is disposed on the regular packing type rectification column 7, and the bottom portion **7*b* of the regular packing type rectification column and the top portion of said condenser 9 are connected with each other by way of the expansion valve V1. The top portion of the condenser 9 and the (first) refrigerant supply side of the heat exchanger 6 are connected with each other by the very low temperature air pipe P9. The top portion 7*a* of the regular packing type rectification column and the (second) refrigerant supply side of the heat exchanger 6 are connected with each other by a low temperature nitrogen gas pipe P8. The said heat exchanger 6, regular packing type rectification column 7, liquid nitrogen storage tank 10 and condenser 9 are accommodated in a vacuum type insulated container 5**.

The nitrogen gas delivery pipe P10 serves to supply product nitrogen gas of high purity which has passed through the heat exchanger 6 to external consumption facilities. To the nitrogen gas delivery pipe P10 is connected the bypass pipe P14. This bypass pipe P14 is connected to the bottom portion of the liquid nitrogen storage tank 10 by way of the inverted U-type pipe P13. An evaporator 11 for evaporating liquid nitrogen and a valve V4 are provided on the way of the bypass pipe P14.

The top portion of the liquid nitrogen storage tank 10 and the bypass pipe P14 are connected with each other by means of a pressurization pipe P22 having a valve V5 and evaporator 12 provided thereon. Further, the top portion of the liquid nitrogen storage tank 10 and the upper end of the inverted U-type pipe P13 are connected with each other by means of a connection pipe P17. The pipe P17 is provided with a valve V3.

The operation of this unit will be described here.

After air as a feed material is freed of dust by means of an air filter (not shown), it is introduced into the compressor 1 and made to be compressed air whose pressure is elevated to a pressure necessary for production of nitrogen gas, for example about 8.5 ata. Then, this compressed air is introduced into the catalyst column 2 through a pipe P1. In the catalyst column 2, an oxidation catalyst such as a palladium catalyst is charged, by which carbon monoxide and hydrogen contained in the compressed air are oxidized under a high temperature atmosphere so as to be turned to carbon dioxide and water, respectively.

Through a pipe P2, the compressed air is then led into the cooler 3, after the compressed air is precooled here, it is introduced into the decarbonating and drying column 4 through a pipe P3. The decarbonating and drying column 4 is filled with alumina or a molecular sieve, and carbon dioxide and moisture in the compressed air are removed here.

Through a pipe P4, the compressed air which has passed through the decarbonating and drying column 4 is introduced into the heat exchanger 6 accomodated in the insulated container (cold box) 5 and it is cooled down nearly to its boiling point (liquefying point) by heat exchange with a refrigerant. The pressure of the compressed air which has come out of the heat exchanger 6 becomes about 8.0 ata and its temperature becomes about −165° C. Then, this compressed air is introduced into the vicinity of the bottom portion of the regular packing type rectification column 7 by way of a pipe P5.

Under the aforementioned pressure and temperature conditions, a part of the compressed air is liquefied and reservoired as oxygen-rich liquid air in the bottom portion **7*b* of the regular packing type rectification column 7, and the remaining part thereof is caused to rise as a nitrogen-rich gas through the regular packing type rectification column 7. Since liquid nitrogen of high purity (with a pressure of about 8.0 ata) is supplied as a reflux liquid to the vicinity of the top portion of the regular packing type rectification column 7**, on the other hand, the nitrogen-rich gas is cooled down in countercurrent gas-liquid contact with the reflux liquid flowing down on the inclined rectifying face of regular packings and it is rectified by the selective liquefaction of its oxygen content so as to become nitrogen gas of high purity and this nitrogen gas is collected in the top portion *7a* of the regular packing type rectification column 7.

After the nitrogen gas of high purity is then sent to the heat exchanger 6 by way of the low temperature nitrogen gas pipe P8 so as to be used as a part of a refrigerant for cooling down the compressed air as the feed material, its temperature becomes normal temperature (at a pressure of about 7.7 ata). Then, the resulting normal temperature nitrogen gas will be sent from the nitrogen gas delivery pipe P10 to external consumption facilities as nitrogen gas of high purity (product).

On the other hand, the oxygen-rich liquid air reservoired in the bottom portion *7b* of the regular packing type rectification column 7 is sent to the expansion valve V1 by way of the pipe P6 and it is adiabatically expanded (at a temperature of about −190° C.) so as to become very low temperature air having a pressure of about 1.8 ata. The very low temperature air is supplied to the condenser 9 disposed over the structured packing type rectification column 7 by way of the pipe P7. In the condenser 9, a part of the nitrogen gas of high purity is recovered from the top portion *7a* of the regular packing type rectification column to liquefy nitrogen gas through an indirect heat exchange with the very low temperature air. The thus-obtained liquid nitrogen is returned to the vicinity of the top portion of the regular packing type rectification column 7 again and used as a part of the reflux liquid. After the very low temperature air coming out of the condenser 9 is sent to the heat exchanger 6 through the very low temperature air pipe P9 so as to be used as a part of a refrigerant for cooling down the compressed air as the feed material, its temperature becomes normal temperature. After the resulting normal temperature air is then sent to the decarbonating and drying column 4 through the pipe P11 so as to be used as a regeneration gas for the decarbonating and drying column 4, it will be discharged to the atmosphere through the pipe P12.

The liquid nitrogen of high purity which is used in the regular packing type rectification column 7 as the reflux liquid is supplied from the bottom portion of the liquid nitrogen storage tank 10 to the vicinity of the top portion of the regular packing type rectification column 7 through the inverted U-type pipe P13, valve V2 and liquid nitrogen introduction pipe P15.

When the nitrogen gas (product) is insufficient because of large demand in a case where only the nitrogen gas of high purity separated and purified in the regular packing type rectification column 7 is supplied, the valve V4 is opened and the evaporator 11 is operated. After the liquid nitrogen in the liquid nitrogen storage tank 10 is introduced into the evaporator 11 through the inverted U-type pipe P13 and bypass pipe P14 and evaporated owing to the aforementioned operation, it is sent to the nitrogen gas delivery pipe P10 through the valve V4 and pipe P20. When the pressure of the liquid nitrogen storage tank 10 is lowered so as to be lower than a predetermined pressure and the amount of liquid nitrogen sent to the regular packing type rectification column 7 is decreased, the valve V5 is opened and the evaporator 12 is operated. After the liquid nitrogen in the liquid nitrogen storage tank 10 is introduced into the evaporator 12 through the inverted U-type pipe P13 and bypass pipe P14 and evaporated owing to the aforementioned operation, it is returned to the top portion of the liquid nitrogen storage tank 10, thereby recovering the pressure of the liquid nitrogen storage tank 10.

When boil-off gas is generated in the liquid nitrogen storage tank 10 by heat permeated from the outside and the pressure thereof is abnormally elevated so as to exceed a predetermined value (for example, about 10.9 ata), the control valve V4 is opened, thereby introducing the boil-off gas to the upper end of the inverted U-type pipe P13. Owing the aforementioned operation, the current of the liquid nitrogen is siphon-broken and momentarily interrupted. By repeating this phenomenon, the boil-off gas in the liquid nitrogen storage tank 10 is absorbed into the liquid nitrogen in the same tank. When the control valve V3 is closed after the pressure of the liquid nitrogen storage tank 10 is stabilized, the boil-off gas remaining in the inverted U-type P13 is also absorbed into the liquid nitrogen in the same pipe, whereby the current of the liquid nitrogen in the same pipe is recovered.

Since an inverted U-type pipe is connected, a liquid nitrogen introduction pipe which connects the bottom portion of a liquid nitrogen storage tank and the top portion of a packing type rectification column with each other, the upper end of said inverted U-type pipe and the top portion of said liquid nitrogen storage tank are connected with each other by means of a pipe and a control valve is provided on the way of said pipe, it becomes possible to interrupt the current of liquid nitrogen from the liquid nitrogen storage tank to the packing type rectification column rapidly when boil-off gas is generated in the liquid nitrogen storage tank. Since the generated boil-off gas is finally absorbed in the liquid nitrogen in the liquid nitrogen storage tank, it becomes possible to operate the unit, without releasing nitrogen gas of high purity to the atmosphere. Furthermore, it becomes possible to dispense with system parts for boil-off gas such as the gas release pipes and heat exchanger and to simplify an installation related to the treatment of boil-off gas.

FIG. 1 is a flow diagram showing one example of the embodiment of a high purity nitrogen gas generator according to the present invention; and FIG. 2 is a flow diagram showing one example of a high purity nitrogen gas generator of the prior art.

We claim:

1. A high purity nitrogen gas generator comprising:

a rectification column (7) in which cooled compressed air is introduced from the vicinity of its bottom portion (*7b*), this compressed air and liquid nitrogen introduced from the vicinity of its top portion are brought into countercurrent contact with each other to liquefy oxygen in the compressed air, and the resulting air is reservoired in the bottom portion as oxygen-enriched liquid and separated nitrogen gas is collected in the top portion;

a liquid nitrogen storage tank (10) for storing liquid nitrogen;

a liquid nitrogen introduction pipe (P15) for supplying liquid nitrogen from the bottom portion of said liquid nitrogen storage tank to the vicinity of the top portion of said packing type rectification column;

a heat exchanger (6) for cooling down the compressed air to be supplied into the packing type rectification column;

an expansion valve (V1) for adiabatically expanding said oxygen-enriched liquid extracted from the bottom portion of the packing type rectification column;

a very low temperature air pipe (P4) for supplying this very low temperature air to said heat exchanger (6) as a refrigerant; and a nitrogen gas delivery pipe (P10) for supplying said nitrogen gas extracted from the top portion of the rectification column to external consumption facilities, characterized in that an inverted U-type pipe (P13) whose upper end is positioned at a height in the vicinity of the top portion of said liquid nitrogen storage tank is connected to the bottom portion of said liquid nitrogen storage tank, said liquid nitrogen storage tank and said liquid nitrogen introduction pipe are connected with each other by way of said inverted U-type pipe, the upper end of the inverted U-type pipe and the top portion of said liquid nitrogen storage tank are connected with each other by means of a connection pipe (P17) and a control valve (V3) is provided on the way of said connection pipe, where when the pressure of said liquid nitrogen storage tanks exceeds a predetermined value, the control valve is opened so as to introduce nitrogen gas from the top portion of said liquid nitrogen storage tank to the upper end of this inverted U-type pipe.

* * * * *